US011104498B2

(12) United States Patent
Schlatter

(10) Patent No.: US 11,104,498 B2
(45) Date of Patent: Aug. 31, 2021

(54) CHAINSAW BLADE STORAGE ASSEMBLY

(71) Applicant: Forest Schlatter, Reelsville, IN (US)

(72) Inventor: Forest Schlatter, Reelsville, IN (US)

( * ) Notice: Subject to any disclaimer, the term of this patent is extended or adjusted under 35 U.S.C. 154(b) by 13 days.

(21) Appl. No.: 16/720,312

(22) Filed: Dec. 19, 2019

(65) Prior Publication Data

US 2021/0188512 A1 Jun. 24, 2021

(51) Int. Cl.

| | |
|---|---|
| ***B65D 73/00*** | (2006.01) |
| ***A45C 11/26*** | (2006.01) |
| ***B27B 17/00*** | (2006.01) |
| ***B25H 3/00*** | (2006.01) |
| *B65D 85/00* | (2006.01) |

(52) U.S. Cl.

CPC ..... *B65D 73/0014* (2013.01); *B25H 3/006* (2013.01); *B27B 17/00* (2013.01); *B65D 85/00* (2013.01)

(58) Field of Classification Search

CPC .... B65D 73/0014; B65D 85/00; B25H 3/006; B25H 3/02; B27B 17/00

USPC ..... 206/348, 349, 461, 806; 269/137, 210, 269/304

See application file for complete search history.

(56) References Cited

U.S. PATENT DOCUMENTS

| | | | | |
|---|---|---|---|---|
| 4,805,889 | A * | 2/1989 | Liepse | B23Q 13/00 269/210 |
| 4,905,948 | A | 3/1990 | Indorf | |
| 5,402,701 | A * | 4/1995 | Ingram | B27B 25/10 269/304 |
| 7,624,862 | B1 * | 12/2009 | Pleggenkuhle | B27B 17/00 206/349 |
| 8,857,612 | B2 | 10/2014 | Crank | |
| 9,193,091 | B1 | 11/2015 | Conklin | |
| 9,346,608 | B2 * | 5/2016 | Sublett | B65D 85/00 |
| 2003/0075467 | A1 | 4/2003 | Anderson | |
| 2005/0139499 | A1 | 6/2005 | Flynn | |
| 2009/0152149 | A1 * | 6/2009 | Allen | B23D 59/00 206/373 |
| 2013/0264236 | A1 * | 10/2013 | Sublett | B65D 85/00 206/349 |
| 2014/0084124 | A1 * | 3/2014 | Crank | B25H 3/006 248/346.07 |
| 2015/0314469 | A1 * | 11/2015 | Conklin | B25H 3/006 206/349 |
| 2020/0016738 | A1 * | 1/2020 | Feaver | B25H 3/02 |
| 2020/0398419 | A1 * | 12/2020 | Hanood | B25H 3/04 |

* cited by examiner

*Primary Examiner* — Luan K Bui

(57) ABSTRACT

A chainsaw blade storage assembly for storing a chainsaw blade includes a panel that is elongated. A first stop is coupled to the panel wherein the first stop and a chainsaw blade can be positioned around the first stop. A second stop is slidably coupled to the panel and the chainsaw blade can be positioned around the second stop. The second stop is positionable a plurality of distances from the first stop to place tension on the chainsaw blade for storage. A pair of fasteners each extends through the second stop and engages the panel to inhibiting the second stop from moving.

5 Claims, 4 Drawing Sheets

CHAINSAW BLADE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing a chainsaw blade.

(2) Description of Related Art Including Information Disclosed Under 37 CFR 1.97 and 1.98

The prior art relates to storage devices. The prior art discloses a pair of storage members that each have a plurality of teeth that engage each other such that the storage members can be adjusted to a variety of lengths for storing a chainsaw blade. The prior art discloses an assembly that includes a pair of chain blocks, each having a curved distal end, which are biased away from each other for storing a chainsaw blade. Additionally, the prior art discloses an assembly that includes a pair of blocks, each with a groove for engaging a chainsaw blade, which are biased away from each other for storing the chainsaw blade. The prior art also discloses an assembly that includes a pair of cylinders that are slidably adjustable away from each other thereby facilitating a chainsaw blade to be extended around the cylinders for storage. The prior art includes a panel, having a fixed engagement and a slidable engagement that can have a chainsaw blade extended therearound for storing the chainsaw blade.

BRIEF SUMMARY OF THE INVENTION

An embodiment of the disclosure meets the needs presented above by generally comprising a panel that is elongated. A first stop is coupled to the panel wherein the first stop and a chainsaw blade can be positioned around the first stop. A second stop is slidably coupled to the panel and the chainsaw blade can be positioned around the second stop. The second stop is positionable a plurality of distances from the first stop to place tension on the chainsaw blade for storage. A pair of fasteners each extends through the second stop and engages the panel to inhibiting the second stop from moving.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
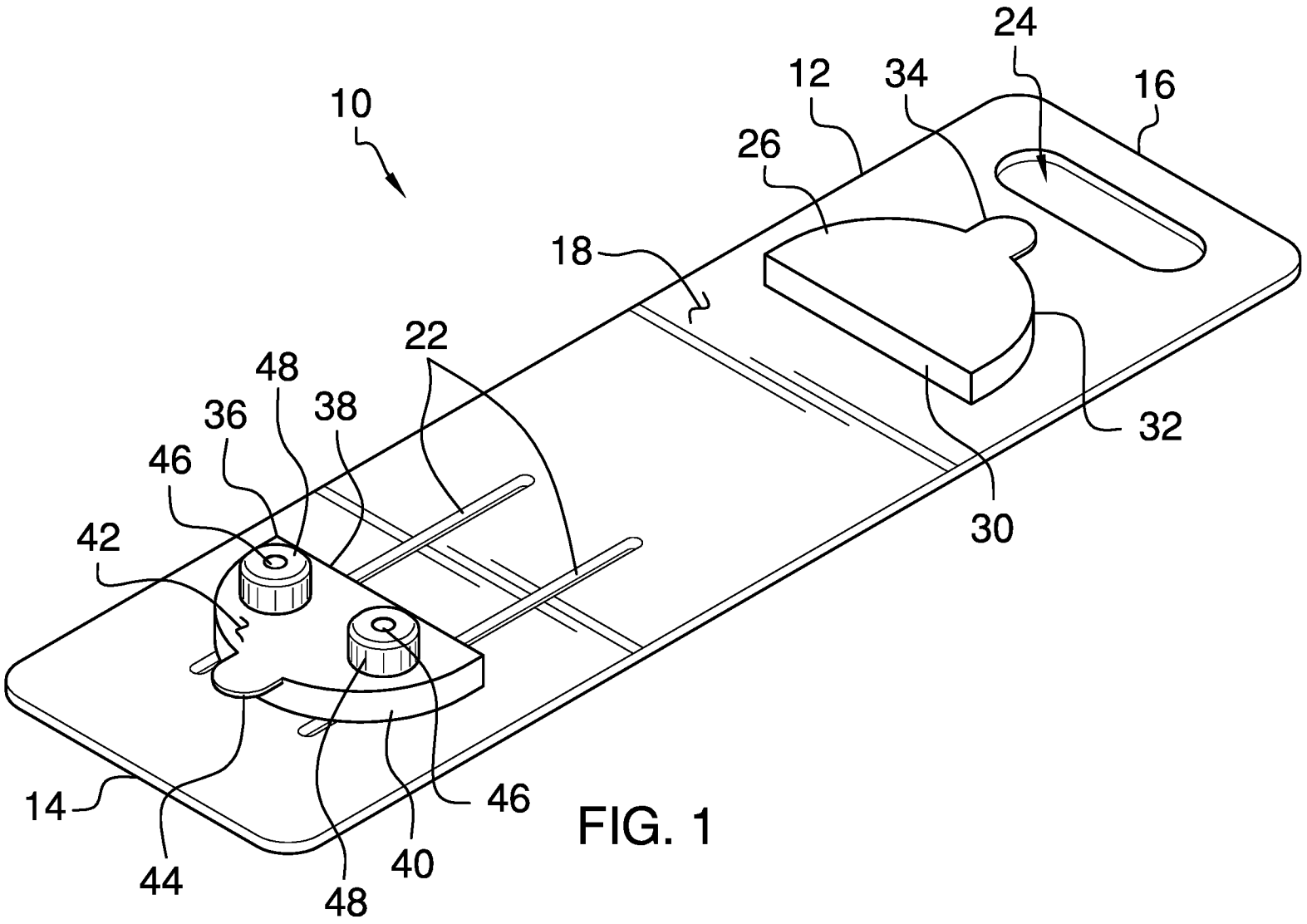
FIG. 1 is a top perspective view of a chainsaw blade storage assembly according to an embodiment of the disclosure.
Figure 2:
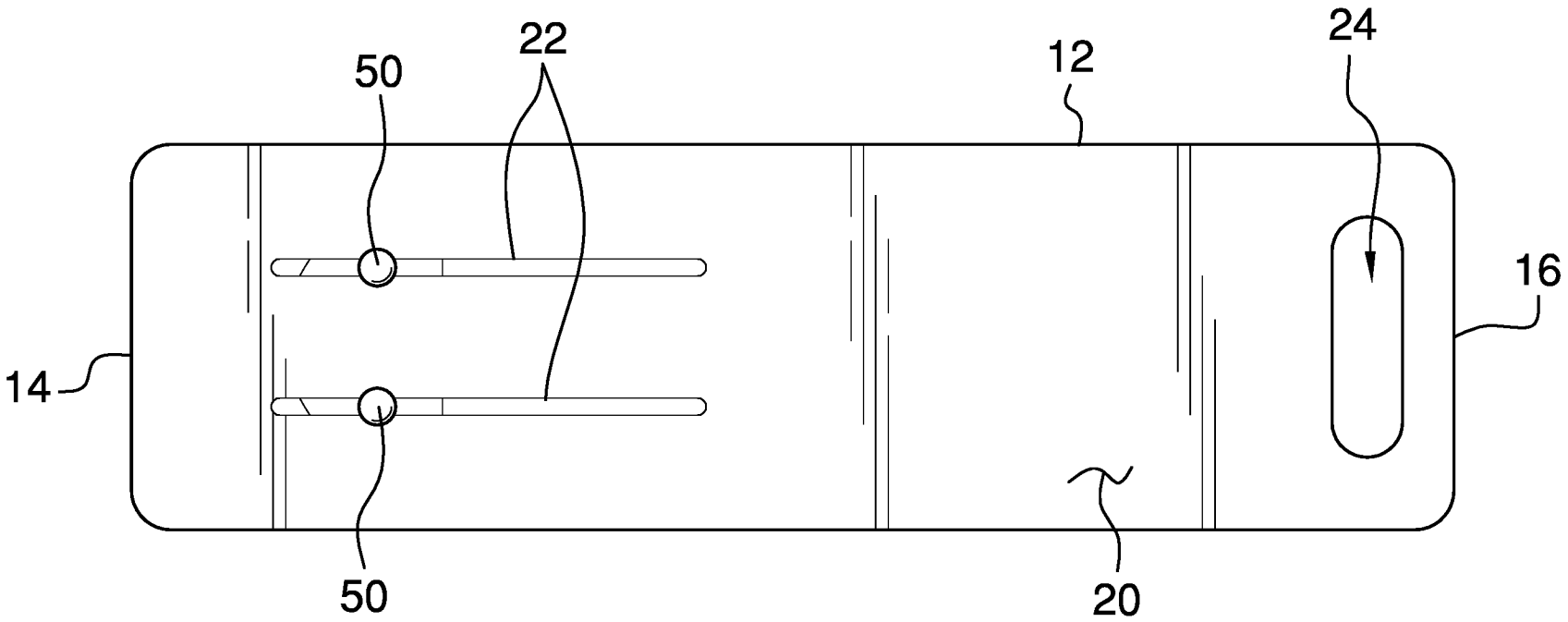
FIG. 2 is a bottom view of an embodiment of the disclosure.
Figure 3:
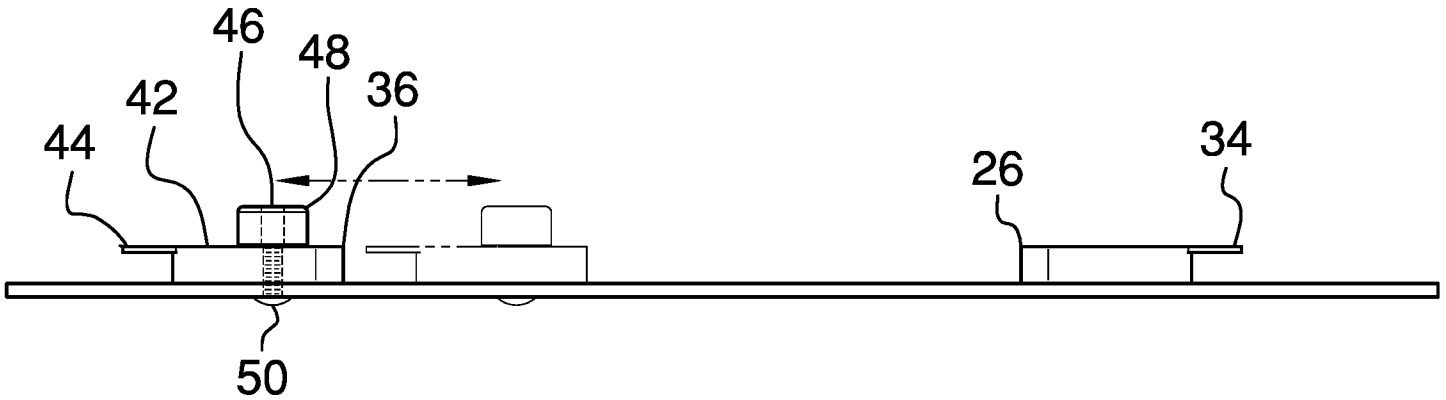
FIG. 3 is a right side view of an embodiment of the disclosure.
Figure 4:
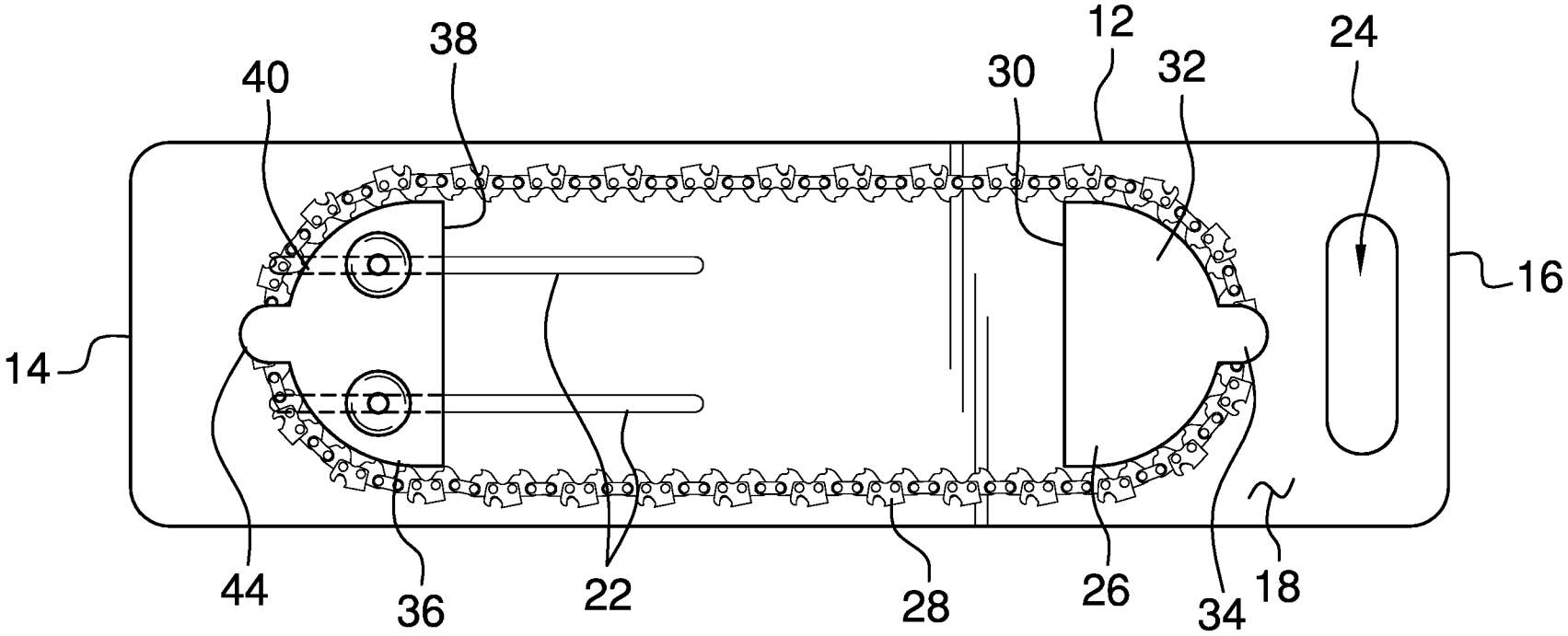
FIG. 4 is a top view of an embodiment of the disclosure.

With reference now to the drawings, and in particular to FIGS. 1 through 4 thereof, a new storage device embodying the principles and concepts of an embodiment of the disclosure and generally designated by the reference numeral 10 will be described.

As best illustrated in FIGS. 1 through 4, the chainsaw blade storage assembly 10 generally comprises a panel 12 that has a first end 14, a second end 16, a top surface 18 and a bottom surface 20, and the panel 12 is elongated between the first end 14 and the second end 16. Moreover, the panel 12 may have a length ranging between, but not be limited to, approximately 12.0 inches and 24.0 inches. The panel 12 has a pair of slots 22 each extending through the top surface 18 and the bottom surface 20. The slots 22 are spaced apart from each other and are oriented collinear with each other. Each of the slots 22 extends partially between the first end 14 and the second end 16. The slots 22 are positioned closer to the first end 14 than the second end 16. The panel 12 has an opening 24 extending through the top surface 18 and the bottom surface 20 to define a grip for gripping the panel 12 and the opening 24 is positioned adjacent to the second end 16.

A first stop 26 is coupled to the panel 12 and a chainsaw blade 28 can be positioned around the first stop 26. The chainsaw blade 28 may be a chainsaw blade of any conventional design and the chainsaw blade 28 may have a length ranging between, but not be limited to, 12.0 inches and 24.0 inches. The first stop 26 is positioned on the top surface 18 of the panel 12 and the first stop 26 is positioned adjacent to the opening 24. The first stop 26 has a front edge 30 and a back edge 32, and the back edge 32 is concavely arcuate with respect to the front edge 30. In this way the back edge 32 can have the chainsaw blade 28 extended therearound. The front edge 30 is directed toward the first end 14 of the panel 12 and the first stop 26 has a tab 34 extending beyond the back edge 32. The tab 34 is spaced from the top surface 18 of the panel 12 to inhibit the chainsaw blade 28 from sliding over the first stop 26.

A second stop 36 is slidably coupled to the panel 12 and the chainsaw blade 28 can be positioned around the second stop 36. The second stop 36 is positionable a plurality of distances from the first stop 26 thereby facilitating the second stop 36 to place tension on the chainsaw blade 28 for storage. The second stop 36 has a forward edge 38, a rearward edge 40 and an upper surface 42, and the rearward edge 40 is concavely arcuate with respect to the forward edge 38. In this way the rearward edge 40 can have the chainsaw blade 28 positioned therearound.

The second stop 36 is oriented such that the forward edge 38 is directed toward the front edge 30 of the first stop 26. The second stop 36 has a tab 44 extending beyond the rearward edge 40 and the tab 44 on the second stop 36 is spaced from the top surface 18 of the panel 12. In this way the tab 44 on the second stop 36 inhibits the chainsaw blade 28 from sliding over the second stop 36. Additionally, the second stop 36 is positioned over each of the slots 22.

A pair of fasteners 46 is included and each of the fasteners 46 extends through the second stop 36 and engages the panel 12. Each of the fasteners 46 inhibit the second stop 36 from moving when the fasteners 46 are tightened. Conversely, the second stop 36 is slidable on the panel 12 when the fasteners 46 are loosened. Each of the fasteners 46 extends through the upper surface 42 of the second stop 36 and downwardly through a respective one of the slots 22. Each of the fasteners 46 includes a knob 48 that is positioned on the upper surface 42 of the second stop 36 and an engagement 50 engaging the bottom surface 20 of the panel 12. The knob 48 on each fastener 46 is threaded thereby facilitating the knob 48 to be tightened or loosened with respect to the upper surface 42 of the second stop 36. Additionally, the engagement 50 is compressed against the bottom surface 20 of the panel 12 when the knob 48 is tightened.

In use, the chainsaw blade 28 is positioned around each of the first stop 26 and the second stop 36. The second stop 36 is slid away from the first stop 26 until tension is placed on the chainsaw blade 28. The knob 48 on each of the fasteners 46 is tightened to inhibit the second stop 36 from sliding. In this way the chainsaw blade 28 can be stored without tangling on itself or twisting into loops. Thus, the chainsaw blade 28 is constantly ready to be installed on a chainsaw without requiring the chainsaw blade 28 to be untangled.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chainsaw blade storage assembly being configured to inhibit a chainsaw blade from tangling during storage, said assembly comprising:

a panel being elongated;

a first stop being coupled to said panel wherein said first stop is configured to have a chainsaw blade positioned therearound;

a second stop being slidably coupled to said panel wherein said second stop is configured to have the chainsaw blade positioned therearound, said second stop being positionable a plurality of distances from said first stop wherein said second stop is configured to place tension on the chainsaw blade for storage; and a pair of fasteners, each of said fasteners extending through said second stop and engaging said panel, each of said fasteners inhibiting said second stop from moving when said fasteners are tightened, said second stop being slidable on said panel when said fasteners are loosened;

said panel has a first end, a second end, a top surface and a bottom surface, said panel being elongated between said first end and said second end;

said panel having a pair of slots each extending through said top surface and said bottom surface, said slots being spaced apart from each other and being oriented collinear with each other, each of said slots extending partially between said first end and said second end, said slots being positioned closer to said first end than said second end; and said panel having an opening extending through said top surface and said bottom surface to define a grip for gripping said panel, said opening being positioned adjacent to said second end;

wherein said first stop is positioned on said top surface of said panel, said first stop being positioned adjacent to said opening, said first stop having a front edge and a back edge, said back edge being convexly arcuate wherein said back edge is configured to have chainsaw blade extend therearound, said front edge being directed toward said first end of said panel; and wherein said first stop has a tab extending beyond said back edge, said tab being spaced from said top surface of said panel wherein said tab is configured to inhibit the chainsaw blade from sliding over said first stop.

2. The assembly according to claim 1, wherein said second stop has a forward edge, a rearward edge and an upper surface, said rearward edge being convexly arcuate wherein said rearward edge is configured to have the chainsaw blade positioned therearound, said second stop being oriented such that said forward edge is directed toward said front edge of said first stop.

3. A chainsaw blade storage assembly being configured to inhibit a chainsaw blade from tangling during storage, said assembly comprising:

a panel being elongated;

a first stop being coupled to said panel wherein said first stop is configured to have a chainsaw blade positioned therearound;

a second stop being slidably coupled to said panel wherein said second stop is configured to have the chainsaw blade positioned therearound, said second stop being positionable a plurality of distances from said first stop wherein said second stop is configured to place tension on the chainsaw blade for storage;

a pair of fasteners, each of said fasteners extending through said second stop and engaging said panel, each of said fasteners inhibiting said second stop from moving when said fasteners are tightened, said second stop being slidable on said panel when said fasteners are loosened;

said panel has a first end, a second end, a top surface and a bottom surface, said panel being elongated between said first end and said second end;

said panel having a pair of slots each extending through said top surface and said bottom surface, said slots being spaced apart from each other and being oriented collinear with each other, each of said slots extending partially between said first end and said second end, said slots being positioned closer to said first end than said second end;

said panel having an opening extending through said top surface and said bottom surface to define a grip for gripping said panel, said opening being positioned adjacent to said second end;

wherein said first stop is positioned on said top surface of said panel, said first stop being positioned adjacent to said opening, said first stop having a front edge and a back edge, said back edge being convexly arcuate wherein said back edge is configured to have chainsaw blade extend therearound, said front edge being directed toward said first end of said panel;

wherein said second stop has a forward edge, a rearward edge and an upper surface, said rearward edge being convexly arcuate wherein said rearward edge is configured to have the chainsaw blade positioned therearound, said second stop being oriented such that said forward edge is directed toward said front edge of said first stop; and wherein said second stop has a tab extending beyond said rearward edge, said tab being spaced from said top surface of said panel wherein said tab is configured to inhibit the chainsaw blade from sliding over said second stop, said second stop being positioned over each of said slots.

4. The assembly according to claim 3, wherein each of said fasteners extends through said upper surface of said second stop and downwardly through a respective one of said slots, each of said fasteners including a knob being positioned on said upper surface of said second stop and an engagement engaging said bottom surface of said panel, said knob being tightenable or loosenable with respect to said upper surface of said second stop, said engagement being compressed against said bottom surface when said knob is tightened.

5. A chainsaw blade storage assembly being configured to inhibit a chainsaw blade from tangling during storage, said assembly comprising:

a panel having a first end, a second end, a top surface and a bottom surface, said panel being elongated between said first end and said second end, said panel having a pair of slots each extending through said top surface and said bottom surface, said slots being spaced apart from each other and being oriented collinear with each other, each of said slots extending partially between said first end and said second end, said slots being positioned closer to said first end than said second end, said panel having an opening extending through said top surface and said bottom surface to define a grip for gripping said panel, said opening being positioned adjacent to said second end;

a first stop being coupled to said panel wherein said first stop is configured to have a chainsaw blade positioned therearound, said first stop being positioned on said top surface of said panel, said first stop being positioned adjacent to said opening, said first stop having a front edge and a back edge, said back edge being convexly arcuate wherein said back edge is configured to have chainsaw blade extend therearound, said front edge being directed toward said first end of said panel, said first stop having a tab extending beyond said back edge, said tab being spaced from said top surface of said panel wherein said tab is configured to inhibit the chainsaw blade from sliding over said first stop;

a second stop being slidably coupled to said panel wherein said second stop is configured to have the chainsaw blade positioned therearound, said second stop being positionable a plurality of distances from said first stop wherein said second stop is configured to place tension on the chainsaw blade for storage, said second stop having a forward edge, a rearward edge and an upper surface, said rearward edge being convexly arcuate wherein said rearward edge is configured to have the chainsaw blade positioned therearound, said second stop being oriented such that said forward edge is directed toward said front edge of said first stop, said second stop having a tab extending beyond said rearward edge, said tab on said second stop being spaced from said top surface of said panel wherein said tab on said second stop is configured to inhibit the chainsaw blade from sliding over said second stop, said second stop being positioned over each of said slots; and a pair of fasteners, each of said fasteners extending through said second stop and engaging said panel, each of said fasteners inhibiting said second stop from moving when said fasteners are tightened, said second stop being slidable on said panel when said fasteners are loosened, each of said fasteners extending through said upper surface of said second stop and downwardly through a respective one of said slots, each of said fasteners including a knob being positioned on said upper surface of said second stop and an engagement engaging said bottom surface of said panel, said knob being tightenable or loosenable with respect to said upper surface of said second stop, said engagement being compressed against said bottom surface when said knob is tightened.

* * * * *